US006783028B1

(12) United States Patent
Ambrose et al.

(10) Patent No.: US 6,783,028 B1
(45) Date of Patent: Aug. 31, 2004

(54) FUEL DISPENSING NOZZLE EQUIPPED WITH A GAME OR OTHER ACTIVITY

(75) Inventors: Alan S. Ambrose, Midland, MI (US); James D. Ferguson, Mt. Pleasant, MI (US)

(73) Assignee: Advanced Information Systems, Midland, MI (US)

( * ) Notice: Subject to any disclaimer, the term of this patent is extended or adjusted under 35 U.S.C. 154(b) by 0 days.

(21) Appl. No.: 09/189,386

(22) Filed: Nov. 10, 1998

(51) Int. Cl.[7] ..... B67D 5/06

(52) U.S. Cl. ..... 222/23; 222/192; 222/113; 222/173; 141/392; 141/94; 221/13; 221/15; 40/299

(58) Field of Search ..... 222/192, 113, 222/23, 173; 141/392, 98, 94; 221/13, 15, 71, 133; 40/299, 584, 610, 611, 649, 661.02, 661

(56) References Cited

U.S. PATENT DOCUMENTS

| | | | | | |
|---|---|---|---|---|---|
| 4,465,209 | A | * | 8/1984 | Wilder | 222/23 |
| 4,673,108 | A | * | 6/1987 | De Man | 222/144.5 |
| 5,131,441 | A | | 7/1992 | Simpson et al. | |
| 5,184,309 | A | * | 2/1993 | Simpson et al. | 141/392 |
| 5,184,655 | A | | 2/1993 | Fell | |
| 5,249,707 | A | | 10/1993 | Simpson et al. | |
| 5,267,592 | A | | 12/1993 | Kaplan et al. | |
| 5,365,984 | A | | 11/1994 | Simpson et al. | |
| 5,505,234 | A | | 4/1996 | Simpson et al. | |
| 5,642,484 | A | | 6/1997 | Harrison, III et al. | |
| 5,717,374 | A | | 2/1998 | Smith | |
| 5,806,217 | A | * | 9/1998 | Alvern | 40/299 |
| 5,810,063 | A | * | 9/1998 | Alvern | 141/392 |
| 5,815,967 | A | * | 10/1998 | Alvern | 40/299 |
| 5,819,450 | A | * | 10/1998 | Alvern | 141/392 |
| 5,822,902 | A | * | 10/1998 | Alvern | 222/192 |
| 5,859,416 | A | | 1/1999 | Gatto | |
| 5,862,617 | A | * | 1/1999 | Alvern | 141/392 |
| 5,864,975 | A | * | 2/1999 | Alvern | 141/98 |
| 5,865,340 | A | * | 2/1999 | Alvern | 222/192 |
| 5,887,367 | A | * | 3/1999 | Alvern | 141/392 |
| 5,890,718 | A | * | 4/1999 | Byon | 463/48 |
| 5,913,180 | A | | 6/1999 | Ryan | |
| 6,024,142 | A | | 2/2000 | Bates | |
| 6,085,805 | A | * | 7/2000 | Bates | 141/94 |
| 6,131,317 | A | * | 10/2000 | Alvern | 40/299.01 |
| 6,182,910 | B1 | * | 2/2001 | Huen | 239/289 |
| 6,374,870 | B1 | * | 4/2002 | Muller | 141/94 |

FOREIGN PATENT DOCUMENTS

| | | | | |
|---|---|---|---|---|
| DE | 4100214 | * | 7/1992 | 141/392 |
| GB | 2147273 | * | 5/1985 | 141/392 |

* cited by examiner

*Primary Examiner*—Dinh Q. Nguyen
(74) *Attorney, Agent, or Firm*—Reising, Ethington, Barnes, Kisselle, P.C.

(57) ABSTRACT

Fuel dispensing nozzles which are equipped with novel systems which enable the user to fuel vehicles, while at the same time, to participate in a passive or interactive activity such as a novel game, quiz, survey, coupon system or, be exposed to an illuminated information area or system. Also included are audio and/or video systems which are electrically or electronically linked to the novel passive or interactive activities.

2 Claims, 9 Drawing Sheets

FUEL DISPENSING NOZZLE EQUIPPED WITH A GAME OR OTHER ACTIVITY

The invention disclosed and claimed herein deals with novel fuel dispensing nozzles which are equipped with a system which enables the user to fuel vehicles, while at the same time, participate in a passive or interactive activity such as a novel game, coupon receipt, be exposed to an illumination system (hereinafter intended to include illuminated information areas, illuminated advertising, illuminated advertising display, illumination systems and the like), participate in a survey, or otherwise interact with the system.

The most fundamental use for devices of this invention are for providing a greater customer awareness of store products, services and special sale items, by increasing the convenience of information at the fuel pump, printed or otherwise, along with, or instead of, participation in a variety of games which may be for recreational or entertainment purposes, or may involve prizes and the like. Further, this customer awareness may be enhanced with this invention because of the unique presentation at the pump through the use of an illuminated information area. In addition, this type of device may be entertaining and because it is entertaining, it encourages the customer to remain with the fuel dispensing nozzle during the dispensing of fuel as is required by law and common sense.

BACKGROUND OF THE INVENTION

This invention deals with novel fuel dispensing nozzles which are equipped with a system which enables the user to fuel vehicles while at the same time participate in a novel game, receive coupons, or be subjected to an illuminated advertising display or information area. This invention provides a capability of providing enhanced customer awareness through the fueling process of a vehicle. "Games" defined herein is intended to include any game, quiz, or survey mechanism that can be essentially reduced to the size required for the use of the housings of this invention, and as long as the game is capable of providing a response to the use of the fuel dispensing device. Such "games" are, for example, quizzes, board games, games of chance, and other such games that exist or can be created. Examples of board games are checkers, dominoes, and chess. Other games are, for example, roulette, dice, poker, and the like. "Illumination" or "illuminated" as used herein means, but is not limited to, lighting on, in, around, and behind the boot, nozzle or device, via electrical or other illumination or illuminant or luminous systems such as, but not limited to, fluorescent, incandescent, ultraviolet, infrared, laser, fiber optic, light emitting diode (LED), field emitter display (FED), liquid crystal display (LCD), plasma display panel (PDP), holographic and/or electroluminescent, chemiluminescent, photoluminescent, bioluminescent, sonoluminescent, thermoluminescent, types of materials or process or the like, to create such types of materials or processes or the like, to create such illumination or illuminated displays or create illumination or luminous effects.

The devices in their simplest form deal with systems to provide illumination for information, advertisements, create games, or provide coupons or tickets that give the customer special incentives or promotions, or provide gifts or prizes by virtue of being a customer at the store providing the devices.

A device is disclosed in U.S. Pat. No. 5,458,170, which issued to Ferguson on Oct. 17, 1995 in which there is described a novel boot and its use on fuel dispensing devices and wherein the boot contains a recording and playback system for messages or sounds as fuel is being pumped into a vehicle. The instant invention is an improvement on those devices and that patent is incorporated herein by reference for all that it teaches about boots, fuel dispensing devices, and methods of dispensing fuel.

Another invention that deals with a boot is that found in U.S. Pat. No. 5,058,637, which issued Oct. 22, 1991 to Fell in which a message display boot is provided for a fuel dispensing nozzle. The display boot in Fell comprises a flexible plastic boot in close conforming fit over at least the front valve housing of the nozzle and the boot has a message platform upon which rests a printed message placard.

Yet another invention that deals with a fixture for a fuel delivery nozzle is shown in WO 97/02554 in the name of Alvern in which there is shown an information carrying device for a fuel dispensing nozzle which is a container with a cover into which is placed an advertising placard. The container attaches to the handle of the nozzle.

The inventors herein are not aware of any other publications with regard to the invention disclosed and claimed herein.

THE INVENTION

The invention herein deals with novel fuel dispensing nozzles which are equipped with a system which enables the user to fuel vehicles while at the same time participate in a novel game, accept coupons, or be subjected to an illuminated display.

In it's broadest sense, this invention deals with an improved fuel dispensing nozzle, said nozzle comprising a spout and a handle for the spout, wherein the improvement comprises the nozzle having contained therein or attached thereto, a system selected from the group consisting essentially of a delivery means for pre-printed coupons; a system comprising a coupon printer and delivery means for the printed coupons; a game system, an illumination system, and, combinations thereof. Contemplated within the scope of this invention is a nozzle which has a housing within the nozzle per se for containing the systems eluded to supra. Further contemplated within the scope of this invention is a nozzle which has a means of attaching the systems to the exterior of the nozzle.

Another embodiment of this invention deals with an improved boot for a fuel dispensing nozzle wherein the boot is adapted for a close conforming fit over at least a front portion of the fuel dispensing nozzle wherein the boot contains a housing. The improvement over the boot disclosed in the '170 patent set forth supra, is the fact that the housing described herein contains a system which is selected from the group consisting essentially of a system comprising a coupon delivery means for pre-printed coupons, a printer for coupons and a delivery means for the printed coupons; a game system; an illumination system, and, various combinations of the above.

There is a further embodiment of this invention wherein there is disclosed and claimed an improved fuel dispensing nozzle comprising a spout, a handle for the spout, and a boot adapted for a close conforming fit over at least a front portion of the fuel dispensing nozzle and, the boot has in it, a housing. The improvement in this embodiment of the invention is that the housing contains in it, a system selected from the group consisting essentially of a system comprising a coupon delivery means for pre-printed coupons, a coupon printer and a delivery means for printed coupons, a game system, an illumination system, and, combinations of a coupon delivery means for pre-printed coupons, a coupon printer and a delivery means for printed coupons, game systems, illumination systems, and combinations of the coupon delivery means for pre-printed coupons, a coupon printer and delivery means for printed coupons, game systems, and illuminated systems.

Another embodiment of this invention is a nozzle comprising a spout, a handle for the spout, a housing of the nozzle per se, and a cavity in the housing for containing a system, wherein the system is selected from the group consisting essentially of (i) a delivery means for pre printed coupons;(ii) a system comprising a coupon printer and delivery means for the printed coupons; (iii) a game system, (iv) an illumination system, and, (v) combinations of (i), (ii), (iii), and (iv).

There is still another embodiment of this invention which is an improved method of providing a passive or interactive activity during the fueling of a vehicle having a fuel port. The method comprises utilizing a fuel dispensing device which is equipped with a fuel dispensing nozzle which comprises a nozzle of this invention wherein the housing contains a system, which has electrically linked to it, a switch for activating and deactivating the system contained therein. "Activity" as used herein means any passive, interactive, or informational function in response to the use of the device, such as games, quizzes, surveys, provision of information, and the like.

The fuel dispensing device is in a deactivated position at the beginning of the fueling and by removing the nozzle from the deactivated position a switch is activated which activates the system. The improvement herein comprises selecting the system from a group consisting essentially of a system comprising a coupon delivery means for pre-printed coupons, a coupon printer and coupons and, a delivery means for the printed coupons, a game system, quiz, and survey mechanism, an illumination system, and, combinations of the coupon delivery means for pre-printed coupons, a coupon printer and coupons and delivery means for the printed coupons, the game systems, quiz, survey mechanism, and illumination systems.

In the method, a coupon is delivered in the case of the use of pre-printed coupons, or in the case of the use of the coupon printer, coupons and delivery means for the printed coupons, a game, quiz, or survey is activated in the case of the use of game system, quiz, or survey mechanism, the boot, nozzle, and/or housing is illuminated in the case of the use of an illumination system.

An additional embodiment of this invention is an improved fuel dispensing nozzle comprising (a) a spout; (b) a handle for the spout, wherein the nozzle has a housing mounted on its exterior surface for containing a system, wherein the system is selected from the group consisting essentially of (i) a delivery means for pre printed coupons; (ii) a system comprising a coupon printer and a delivery means for the printed coupons; (iii) a game system, (iv) an illumination system, and, (v) combinations of (i), (ii), (iii), and (iv).

There is a further aspect of this invention which is a method of providing a passive or interactive activity such as quizzes, board games, games of chance, and the like, during the fueling of a vehicle, said method comprising providing a housing on, in, or near a fuel nozzle, wherein the housing contains in it, a system having electrically linked to it, a switch for activating and deactivating the system.

There is further provided a means by which the switch is activated, which in turn activates the system to provide the passive or interactive activity during the time of fueling. In this aspect, the system is selected from a group consisting essentially of a system comprising a coupon delivery means, a coupon printer and coupons and a delivery means for printed coupons. There is also 0 provided a game system, quiz, or survey, and finally, there is provided an illumination system for illuminating any advertisement or information area in the boot, nozzle, or housing. It is contemplated within the scope of this aspect of the invention to also utilize combinations of the above. Thus, a coupon is delivered in the case of the use of pre-printed coupons and a delivery system, the coupon and printer system; a game, quiz, or survey is activated in the case of the use of the game, quiz, or survey system; and the boot, nozzle, or housing is illuminated in the case of the use of the illumination system.

Still yet, there is a further embodiment of this invention which is an improved method of providing an activity during the fueling of a vehicle having a fuel port, said method comprising: (I) utilizing a fuel dispensing device which is equipped with a fuel dispensing nozzle comprising (a) a spout; (b) a handle for the spout; (c) a boot adapted for a close conforming fit over at least a front portion of the fuel dispensing nozzle; (d) said boot having integrally surmounted thereon, a housing; (e) said housing containing therein a system having electrically linked thereto a switch for activating and deactivating the system; which fuel dispensing device is in a deactivated position at the beginning of the fueling; (II) removing said nozzle from the deactivated position whereby the switch is activated, which activates the system, the improvement comprising selecting the system from a group consisting essentially of (i) a delivery means for pre-printed coupons; (ii) a system comprising a coupon printer and coupons and, a delivery means for printed coupons; (iii) a game system; (iv) an illumination system, and, (v) combinations of (i), (ii), (iii), and (iv); wherein a pre-printed coupon is delivered in the case of the use of system (i), a coupon is printed and delivered in the case of the use of system (ii), a game is activated in the case of the use of system (iii), the boot, nozzle, or housing is illuminated in the case of the use of system (iv).

A further embodiment of this invention is an improved method of providing an activity during the fueling of a vehicle having a fuel port, said method comprising (I) utilizing a fuel dispensing device which is equipped with a fuel dispensing nozzle comprising: (a) a spout; (b) a handle for the spout; wherein the nozzle has a housing mounted on its exterior surface for containing a system wherein the system has electrically linked thereto a switch for activating and deactivating the system; which fuel dispensing device is in a deactivated position at the beginning of the fueling; (II) removing said nozzle from the deactivated position whereby the switch is activated, which activates the system, the improvement comprising selecting the system from a group consisting essentially of (i) a delivery means for pre-printed coupons; (ii) a system comprising a coupon printer and coupons and, a delivery means for printed coupons; (iii) a game system; (iv) an illumination system, and, (v) combinations of (i), (ii), (iii), and (iv); wherein a pre-printed coupon is delivered in the case of the use of system (i), a coupon is printed and delivered in the case of the use of system (ii), a game is activated in the case of the use of system (iii), the nozzle or housing is illuminated in the case of the use of system (iv), and finally, there is an embodiment of this invention which is an improved method of providing an activity during the fueling of a vehicle having a fuel port, said method comprising (I) utilizing a fuel dispensing device which is equipped with a fuel dispensing nozzle comprising (a) a spout; (b) a handle for the spout; wherein the nozzle has a housing mounted on its exterior surface for containing a system wherein the system has electrically linked thereto a switch for activating and deactivating the system; which fuel dispensing device is in a deactivated position at the beginning of the fueling; (II) removing said nozzle from the deactivated position whereby the switch is activated, which activates the system, the improvement comprising selecting the system from a group consisting essentially of (i) a delivery means for pre-printed coupons; (ii) a system comprising a coupon printer and coupons and, a delivery means for printed coupons; (iii) a game system; (iv) an illumination system, and, (v) combinations of (i), (ii), (iii), and (iv); wherein a pre-printed coupon is delivered in the case of the use of system (i), a coupon is printed and delivered in the case of the use of system (ii), a game is activated in the case of the use of system (iii), the nozzle or housing is illuminated in the case of the use of system (iv).

It is contemplated within the scope of this invention to integrate the systems claimed herein with one or more of audio systems and/or video systems. The linking of an audio or video system with the systems described herein can either be hard wired or wireless wherein a wired or wireless sound or video system for messages or sounds is provided while the fuel is being pumped into a vehicle. The audio or video apparati are designed such that they can be activated when the novel systems described herein are activated, such as through the fuel dispensing device when it is inverted to pump fuel into the vehicle and they can be deactivated when the fuel dispensing device is brought to vertical or near vertical or, by some other mechanism such as a switch dislocated from the systems of this invention. The device can be deactivated in conjunction with any of the systems or separately.

Thus, the invention essentially also consists of several embodiments wherein a wireless or hard wired sound or video system is linked with the novel systems of this invention such as a combination of the fuel dispensing device, wherein an activating switch can be adapted to the fuel hose rather than the fuel nozzle, and the systems that have a housing can also contain such sound and video equipment. Such audio systems can be for example those set forth and described in U.S. Pat. No. 5,458,170, which is hereby incorporated by reference for what it teaches about audio systems and their use.

It is also contemplated within the scope of this invention that the systems can be modular or interchangeable enclosures and that such modules or interchangeable enclosures can be for all of the system, or for only a portion of the system. "Integrated" for purposes of this invention means that such video and/or audio systems are mechanically, electrically and/or electronically linked together with such inventive systems.

DETAILED DESCRIPTION OF THE INVENTION

Figure 1:
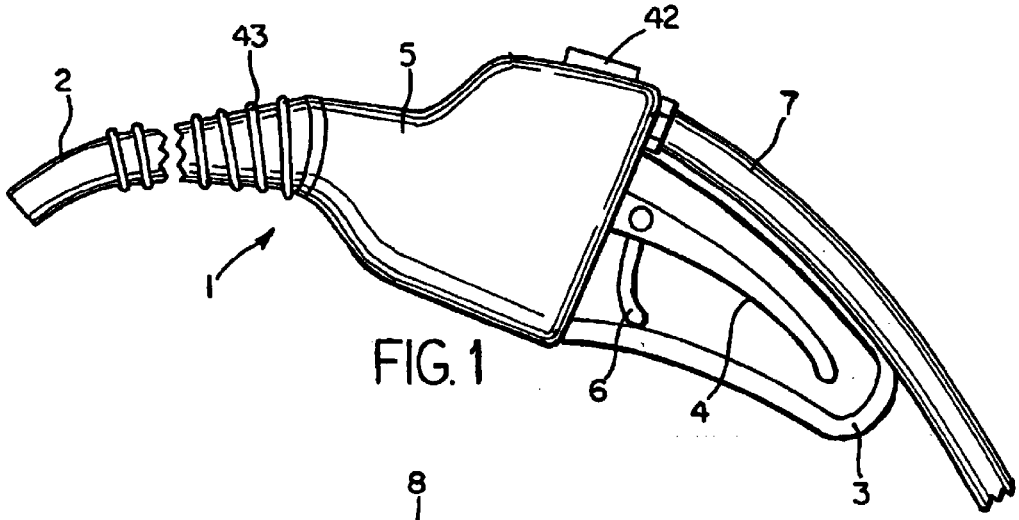
FIG. 1 is a full side view of a standard fueling nozzle which is not within the scope of this invention.

Turning now to FIG. 1, there is shown a full side view of a standard fueling nozzle 1. This nozzle comprises a spout 2, a handle 3, a fuel activating handle 4, and a housing 5 with a shut off apparatus 6 and a hose 7 connecting into the rearward portion of the housing 5.

Figure 2:
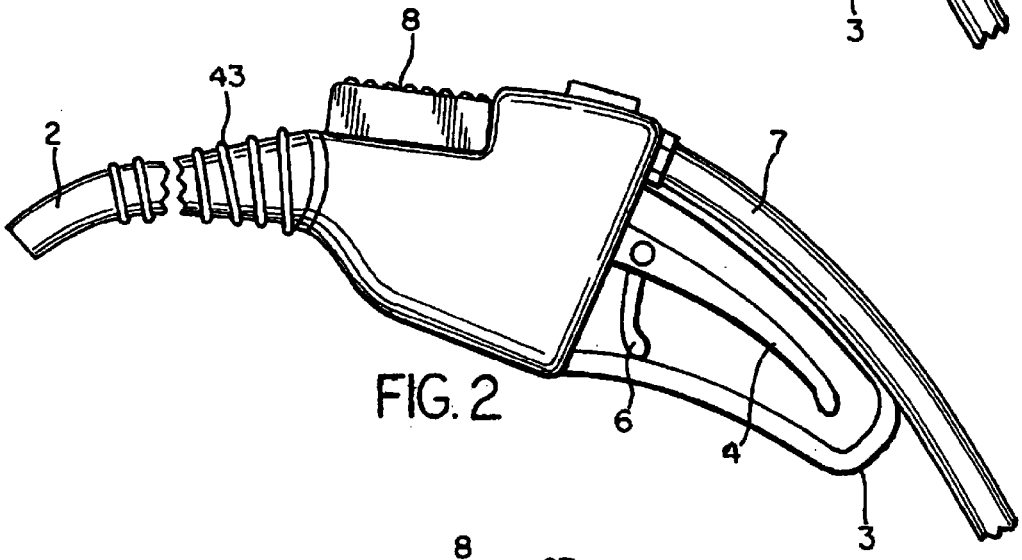
FIG. 2 is a full side view of one embodiment of a fueling nozzle of this invention.

Shown in FIG. 2 is one embodiment of this invention, which is the standard nozzle of FIG. 1, having mounted on its forward portion, a roulette game 8, to be described in detail infra, the details of the actual connection of the game 8 to the housing 5 also being described infra.

Figure 3:
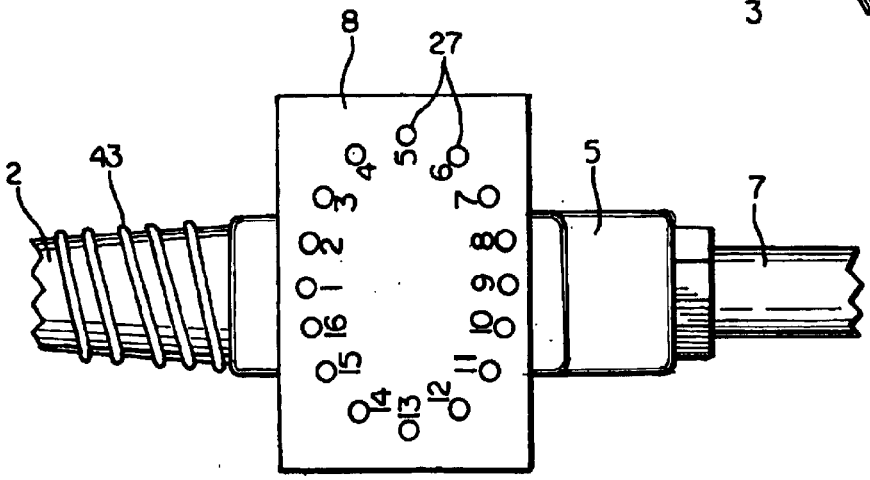
FIG. 3 is a top view of FIG. 2, showing a portion of the nozzle with a roulette game externally mounted on the nozzle within this invention

FIG. 3 is a top view of a portion of FIG. 2, showing the hose 7, the housing 5, and the roulette game 8.

Figure 4:
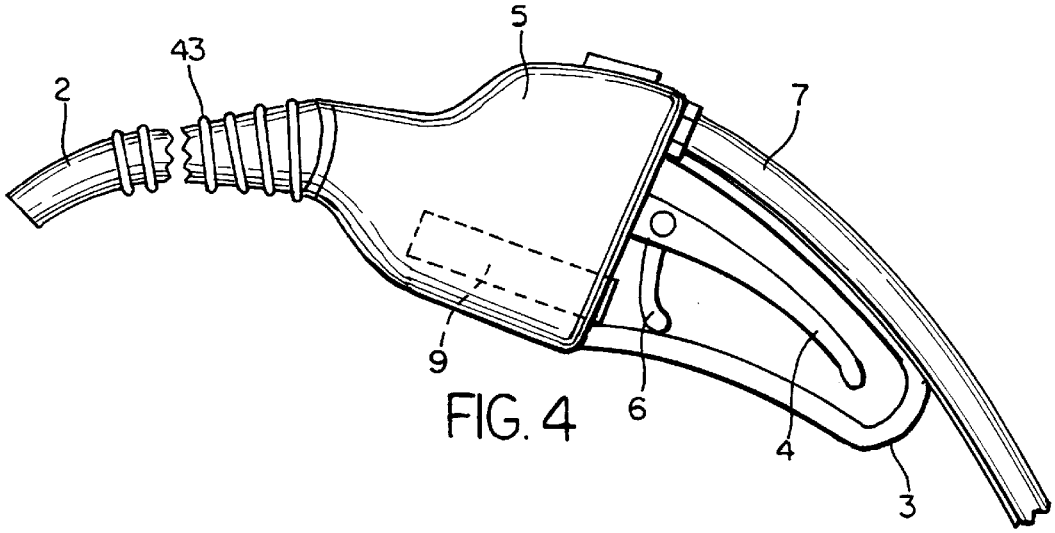
FIG. 4 is a side view of FIG. 1 showing a housing in phantom, in which a system can be housed internally in the nozzle within this invention.

FIG. 4 is a full side view of the standard nozzle of FIG. 1, in which there is shown a cavity 9 which is situated interior to the housing 5 and into which there can be inserted a system of this invention, such as a coupon dispenser or the like (not shown).

Figure 5:
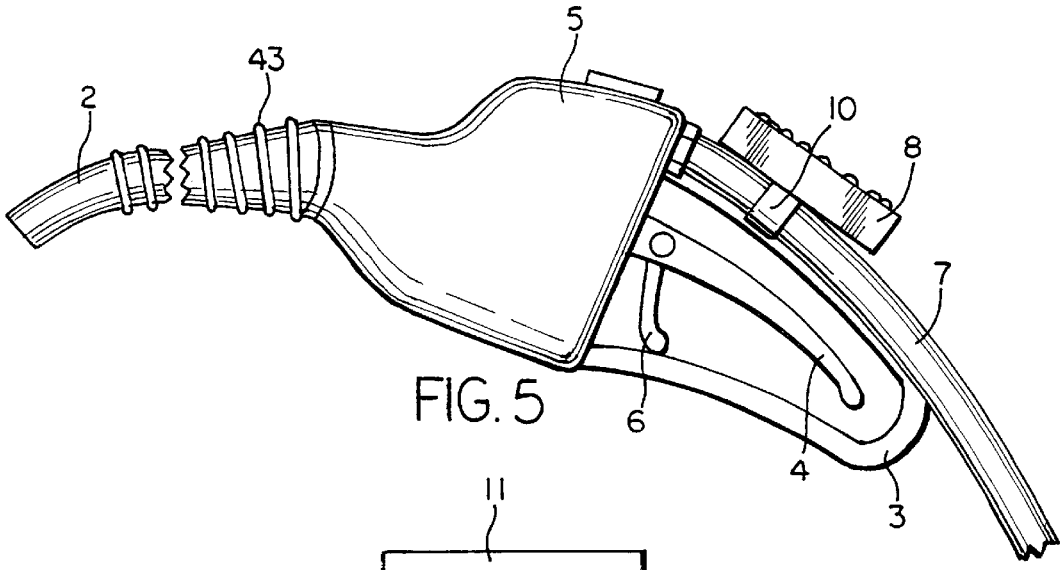
FIG. 5 is a full side view of FIG. 1 showing an externally mounted game on the handle of the nozzle within this invention

In FIG. 5, there is shown the mounting of the roulette game 8 on the hose 7 in combination with the upper portion of the handle 3, the mounting being accomplished by a simple securable band 10.

Figure 6:
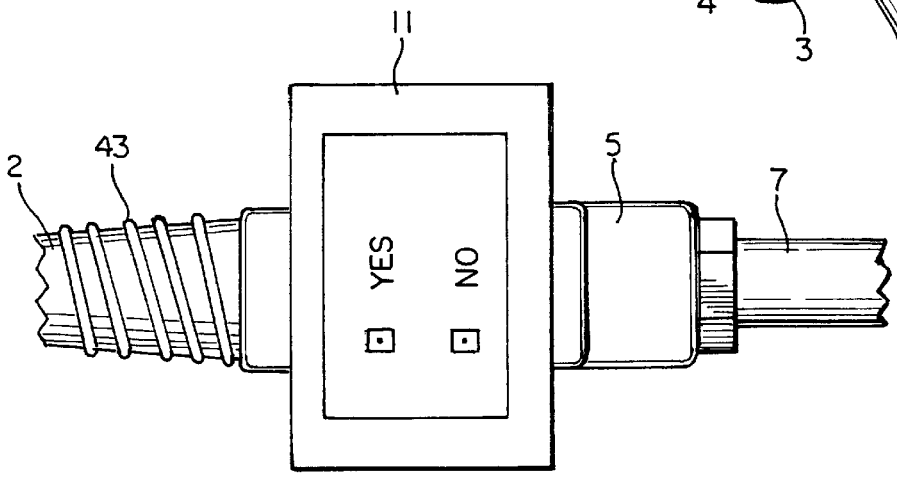
FIG. 6 is a partial top view of a nozzle of this invention showing an active survey system.
Figure 7:
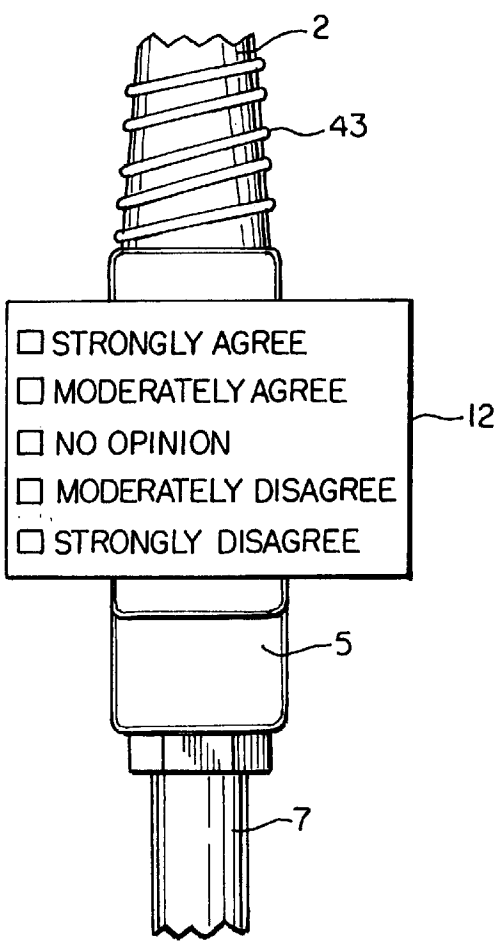
FIG. 7 is a partial top view of a nozzle of this invention showing an active opinion survey.

FIG. 6 shows the mounting of an information collection module 11 on the top of the nozzle and FIG. 7 shows a system for conducting a survey 12 mounted on the top of the nozzle.

Figure 9:
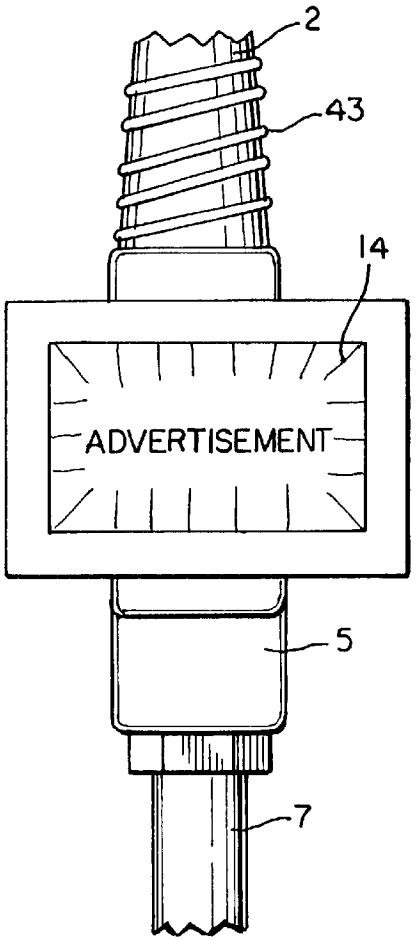
FIG. 9 is a partial top view of a nozzle of this invention showing a back illuminated system.
Figure 8:
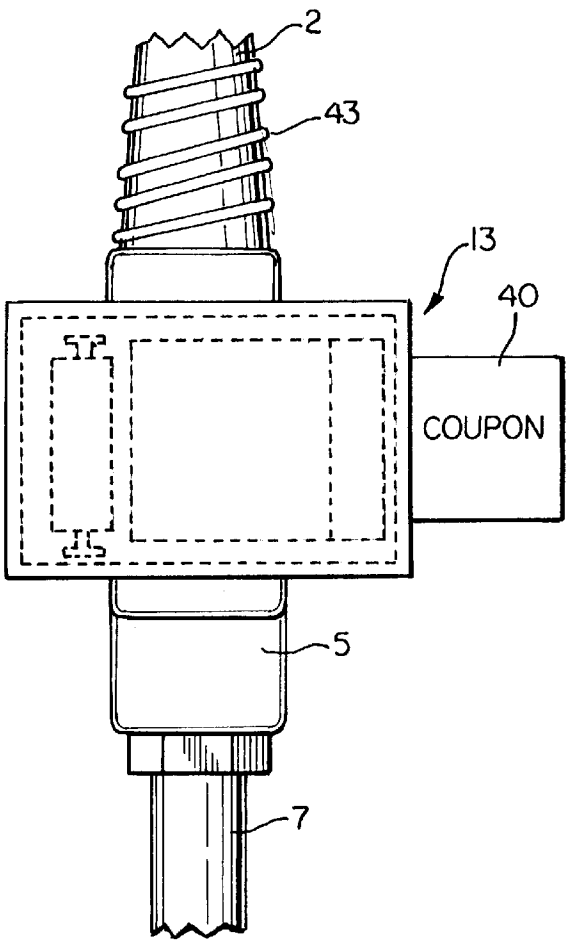
FIG. 8 is a partial top view of a nozzle of this invention showing a coupon dispenser system.

FIG. 8 shows a coupon dispenser 13 mounted on the top of the nozzle and FIG. 9 shows the mounting of an illumination system 14 on the top of the nozzle.

Figure 10:
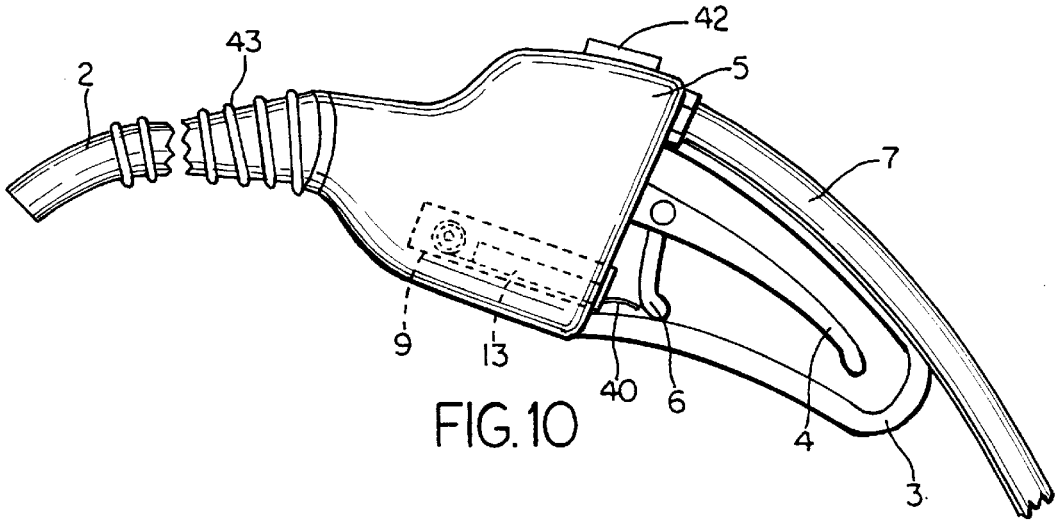
FIG. 10 is a full side view of a nozzle of this invention showing a cavity or housing in the housing of the nozzle per se, which contains a system of this invention therein.

FIG. 10 shows a nozzle with an interior cavity 9 (shown in phantom) containing a coupon dispenser 13, also shown in phantom.

Figure 11:
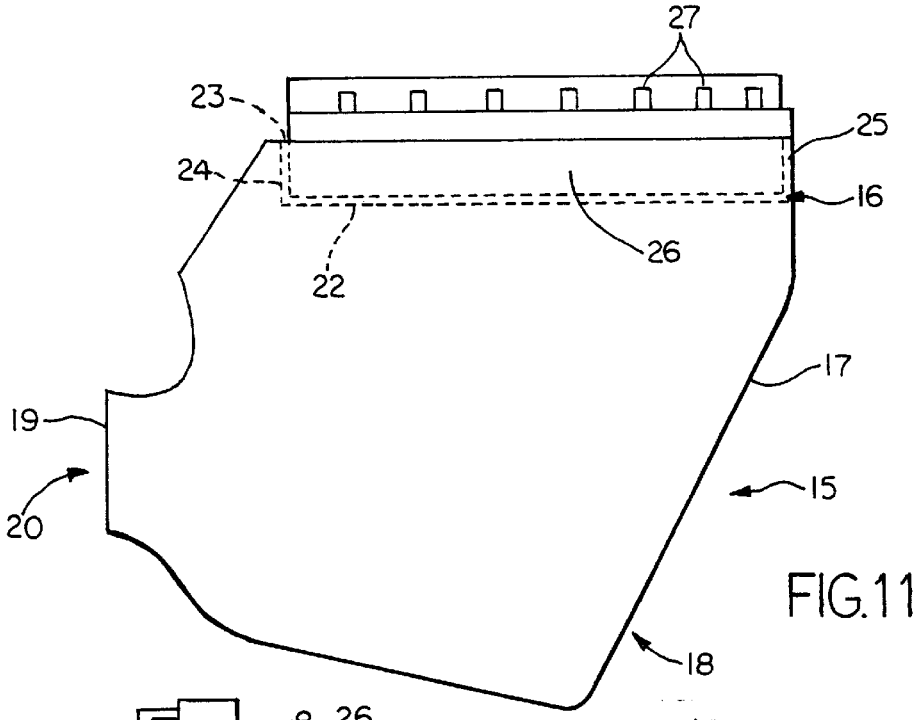
FIG. 11 is a full side view of the boot of this invention.

FIG. 11 shows a full side view of a boot 15 of this invention.

Figure 12:
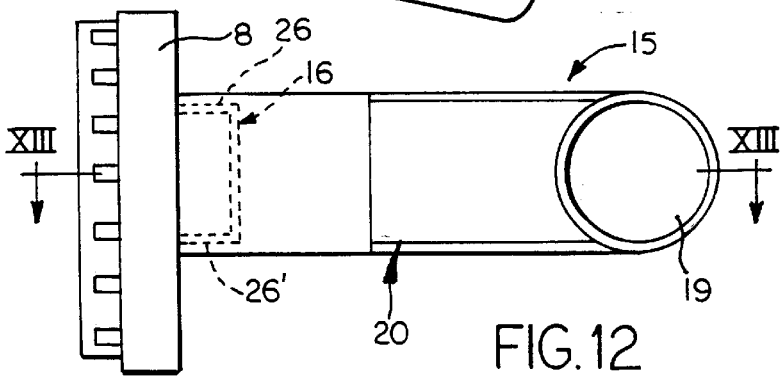
FIG. 12 is a full front view of the boot of FIG. 11 containing a system of this invention.

FIG. 12 shows a full front view of the boot 15 of FIG. 11, showing the opening 19, the front end 20, the roulette game 8 and the housing 16 (shown in phantom).

With reference to FIG. 11, there is shown a housing 16 integrally molded into and forming part of the boot 15, which housing 16 is utilized to house the systems of this invention when a boot is used, the details of which are detailed infra.

The boot 15 has an opening 17 in the back end 18 and a smaller opening 19 in the front end 20, which openings 17 and 19 allow for the positioning of a fuel dispensing device therein. The housing 16 is comprised of an open chamber 21 (FIG. 13) having a bottom 22, a top 23, front end 24, back end 25, and sides 26 and 26'.

Figure 13:
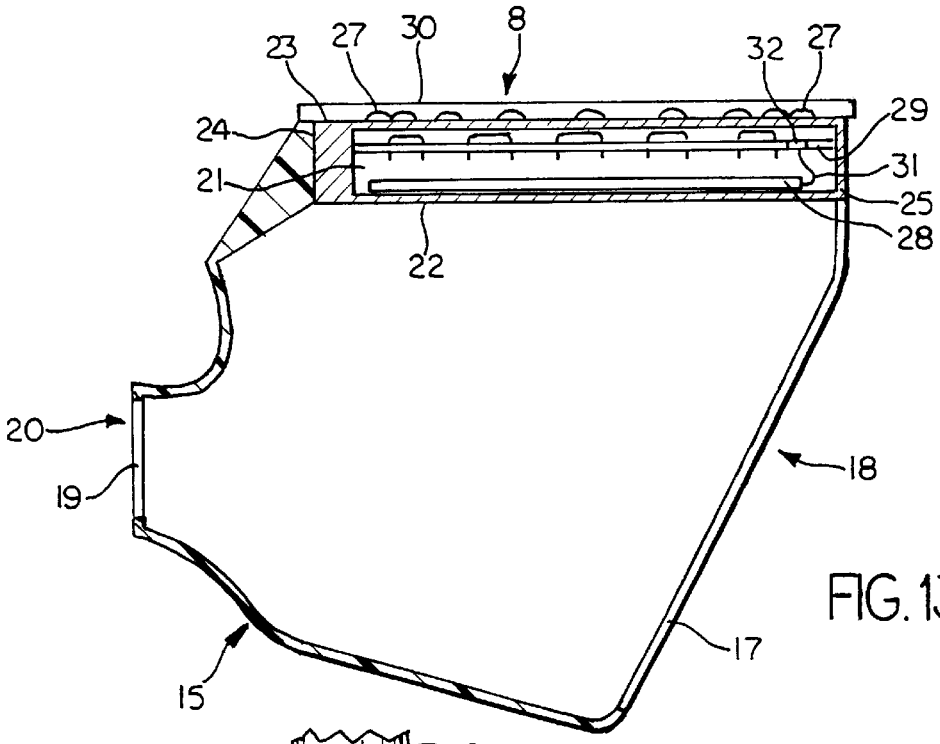
FIG. 13 is a cross-sectional view of the boot of FIG. 12, taken through the line XIII—XIII.
Figure 14:
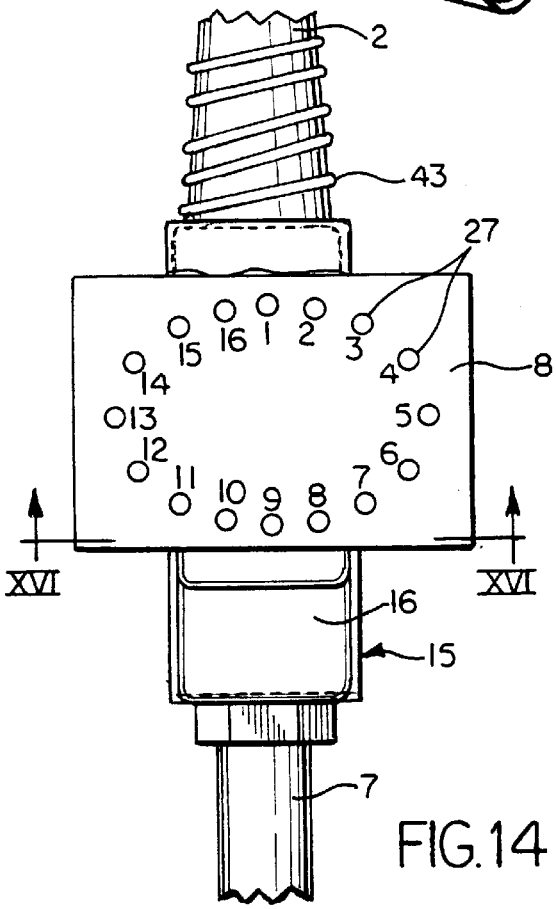
FIG. 14 is a partial top view of a nozzle showing the game system in place.
Figure 16:
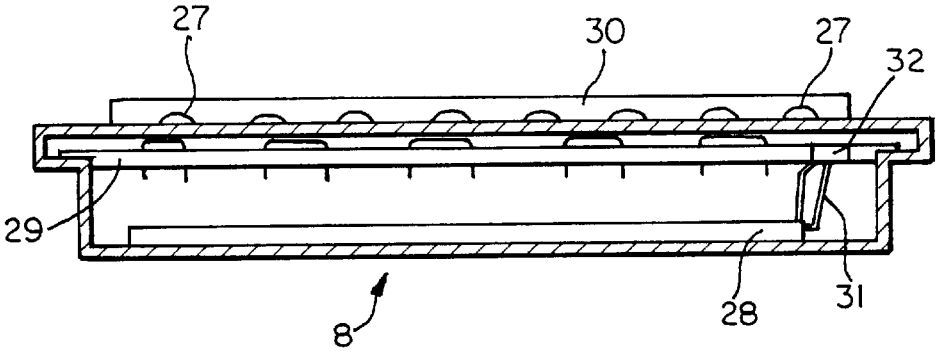
FIG. 16 is a full cross-sectional view of the system in FIG. 14, through the line XVI—XVI.

Turning now to FIG. 13, there is shown a full cross-sectional view of the boot of FIG. 12 through the XIII—XIII wherein there is shown a roulette game 8, but it is contemplated within the scope of this invention that many other similar games can be utilized in this invention such as quizzes, board games, games of chance, and other such games that exist or can be created. Examples of board games are checkers, dominoes, and chess. Other useful games include roulette, dice, poker, and the like. These games can be powered electrically or they can be powered mechanically. The detail of the roulette game can be found in FIG. 3, which is a partial top view of the nozzle and also FIG. 16, which is a full cross-sectional side view of the game 8.

The top of the roulette game 8 is shown in FIG. 3 wherein the number 27 designates the numbered lights. With further specific reference to FIG. 13, there is additionally shown a battery 28, a circuit board 29 for the lights 27, and a transparent shield 30, that can protect the game 8 from damage from the outdoor elements. There is also shown an electrical connection 31 from the battery 28 to the circuit board 29 and, an electrical switch 32. The game 8 is powered by the battery 28 through the electrical connection 31, which powers the circuit board 29, which controls the game 8.

By way of example, the games 8 of this invention, such as the roulette game system, can use electronic lights to simulate a ball on a roulette game. The individual lights are electronically controlled such that when stimulated, each light is illuminated momentarily in quick sequence and in so doing simulates the ball's position and final stationary position on a roulette game surface. In addition, a dice game can be simulated in the same manner by providing a light configuration in which there are only six lights, and the electronics of the game controls certain lights at random and fixes them such that they emulate the dots on the face of a die. That is, if two lights remain lighted, then the die shows a two, if six lights remain lighted at the end of the game, then the die shows six. In this manner, the programmer can select certain numbers that will be associated with prizes, or merchandise specials that are reduced in price for the game. The exact electronic configurations are not complex, and can be found in many marketed entertainment or recreational products. They can also be readily assembled from component parts that are commercially available. There is also provided such electronics in the form of kits which enable one to build a roulette game or the like. Further it is contemplated to include simulated sports games, for example, baseball, football, basketball, and those types of games found in hand held electronic systems currently in commerce and or games created especially for the device.

In a similar manner, the coupon system of this invention can be electronically controlled to dispense coupons upon the use of the fueling nozzle, which coupons can be associated with prizes, reductions in prices, or other incentives or merchandise. The systems of this invention can be individual components or can be modular, in the sense that one system can be interchanged with another system by merely extracting one system from the housing, and putting another in its place without having to modify the housing or any other components of the invention.

The systems of this invention can be activated in many ways, for example, the systems can be designed such that the systems are activated when the fuel dispensing device is removed from the fuel pump, or inverted to pump fuel into the vehicle, and can be deactivated when the fuel dispensing device is brought to a vertical, or near vertical position, or replaced in the holder for the dispensing device. The device can be thus deactivated by mere removal of the dispensing device, or by mere vertical orientation of the fuel dispensing device.

In the alternative, the systems can be activated and deactivated by a push button switch or other types of switch mechanisms located near the systems and which can be operated by the consumer. In addition, the switch does not have to be located in the housing with the rest of the system, it can be dislocated.

In addition, apparatus can be included in the systems to provide for the activation or deactivation of the system from remote locations, other than at the fuel dispensing device.

It is contemplated within the scope of this invention that the systems can be linked via electrical hard wire, or can be wireless, and the device can receive or transmit commands and/or information by such means. Typical wireless technology that can be employed is referenced in EDN, Feb. 16, 1998 in addition to that described infra in Survey of Rural Information Infrastructure Technologies.

This electrical hard wiring and wireless configuration also means that the devices, i.e. systems of this invention, can be programmed, operated, or controlled from a location remote from where a device of this invention is being used.

Figure 15:
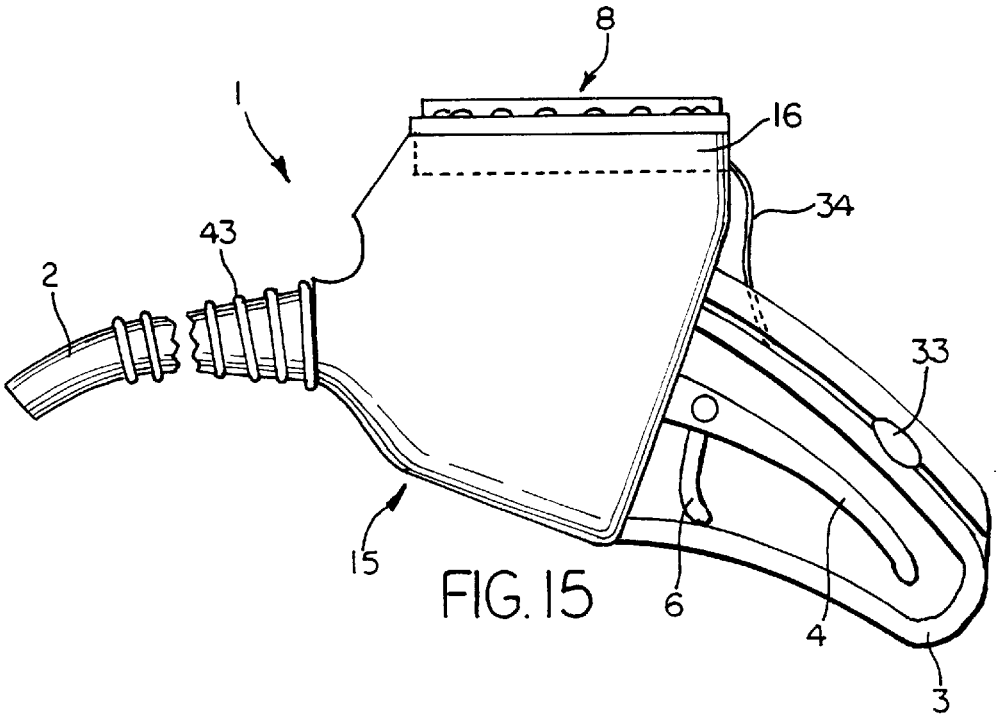
FIG. 15 is a full side view of a nozzle of this invention showing the alternative switch system.

There is a further embodiment of the invention shown in FIG. 15, which is a full side view of a nozzle 1 with the boot 15 in place.

The housing 16 is shown in phantom. Also shown is an alternative switch 33, which is located outside of the housing 16 and is located in the handle 3 of the nozzle 1. The game 8 is shown mounted in the housing 16. Also shown is a fuel activation handle 4, an electrical connection 34 from the switch 33 to the battery 28 (not shown in this Figure) in the housing 16.

Turning now to a further embodiment of this invention, which is a means of providing coupons to the customer at the fuel pump. Such means can be observed with reference to FIGS. 17 and 18, wherein there is shown in FIG. 18, a full cross-section view of a boot 1 of this invention through line XVIII—XVIII of FIG. 17 wherein there is located a coupon printer 35, a roller 36, containing coupons 40, situated on a delivery mechanism 37 comprised of a roller 38, and, two stanchions 39 and 39' for supporting the roller 36.

Figure 17:
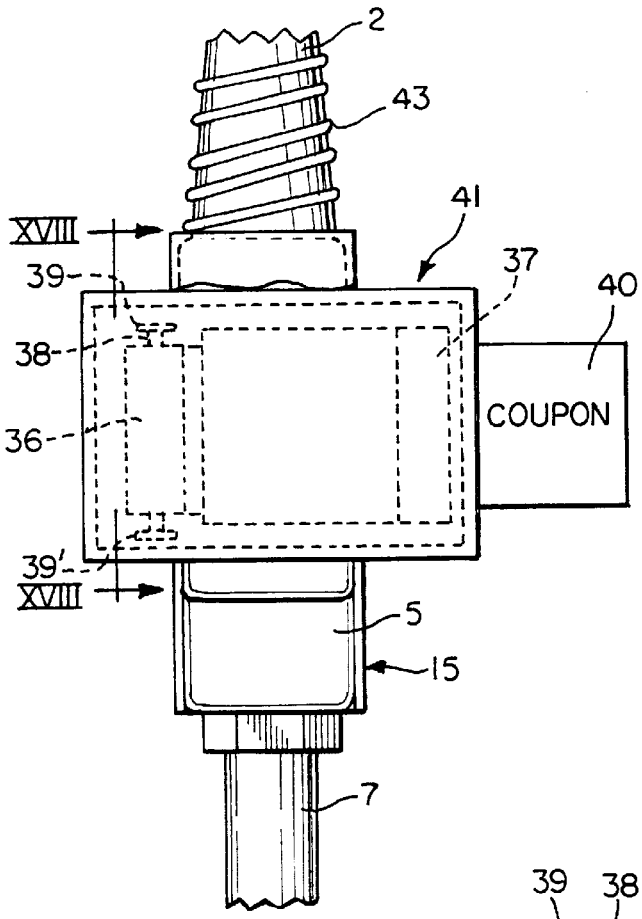
FIG. 17 is a partial top view of a nozzle of this invention showing a coupon dispensing system in place of the roulette game system.

With regard to FIG. 17, which is a full top view of a nozzle 1 as shown essentially in FIG. 15, except that the roulette game 8 has been replaced by coupon system 41, there is shown in addition to those elements described above, a coupon 40, and a coupon delivery means 37 (shown in phantom).

Figure 18:
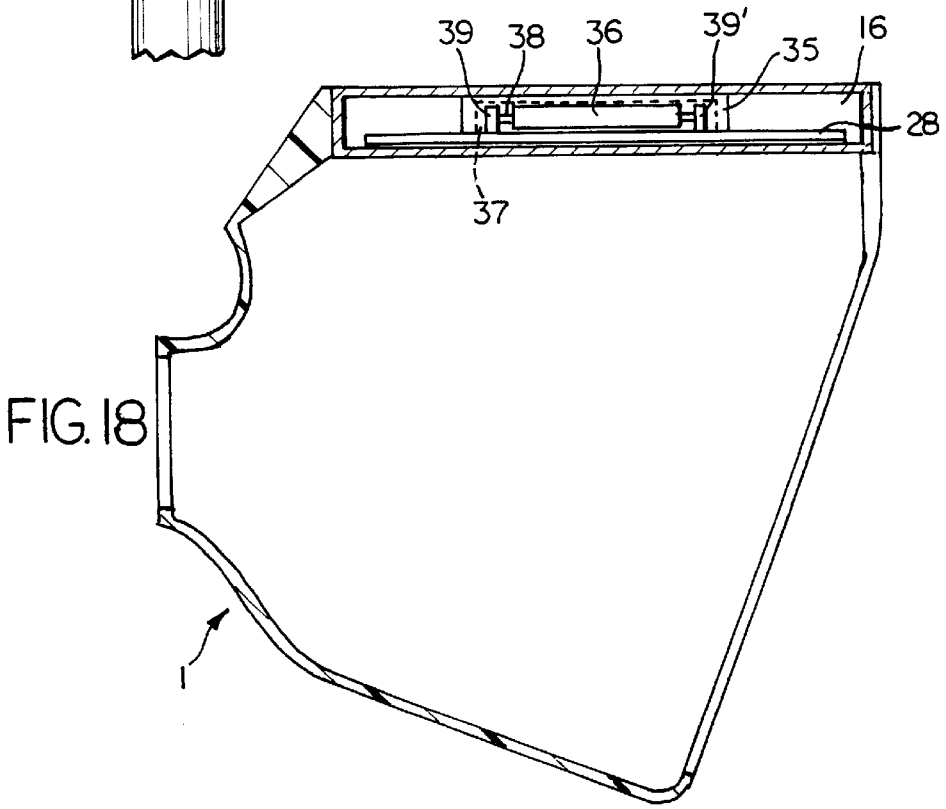
FIG. 18 is a cross-sectional side view of a fuel nozzle of FIG. 17 through the line XVIII—XVIII.

In FIGS. 15, 17 and 18, there is also shown the components of the nozzle 1, which are, for clarification, the fuel hose 7, which is shown partially, the handle 3, a cap 42 for the fuel control device within the pump handle (not shown) which controls the flow of the fuel through the nozzle 1 and the wound wire 43, which is a device which is used on fuel nozzles such that they cannot dispense the wrong fuel into a vehicle not intended to have the fuel.

Figure 20:
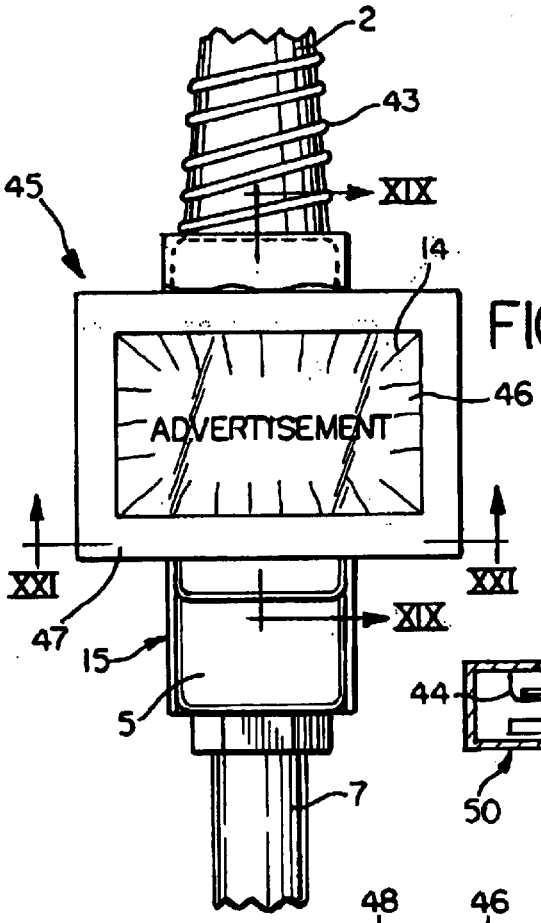
FIG. 20 is a partial top view of a nozzle of this invention showing an illuminated system.
Figure 21:
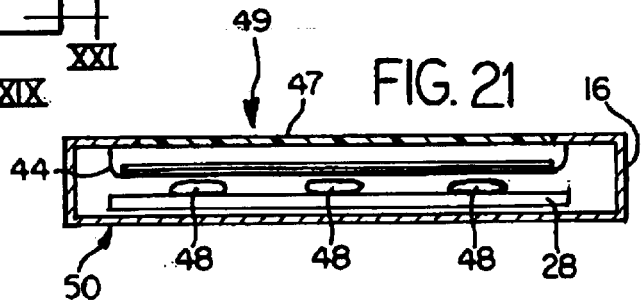
FIG. 21 is a cross-sectional view of just the system of FIG. 20, through the line XXI—XXI.
Figure 19:
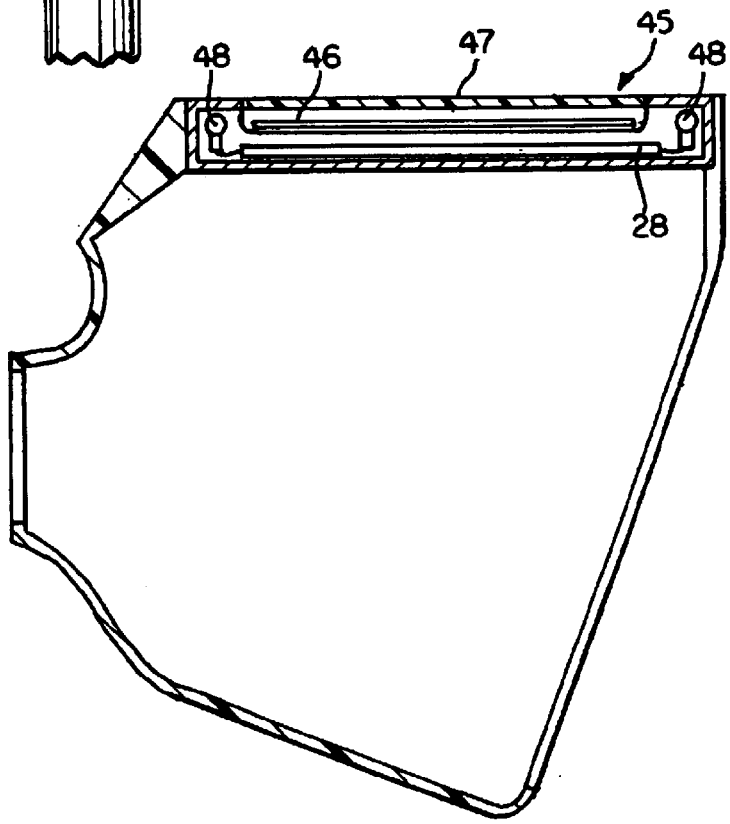
FIG. 19 is a cross-sectional side view of the nozzle of FIG. 20, through the line XIX—XIX.

Now, with regard to another embodiment of this invention, there is shown in FIGS. 19, 20, and 21, one illumination system 45 of this invention. FIG. 19 is a cross-sectional side view of the boot 15 taken through the line XIX—XIX of FIG. 20, except that the roulette game 8 has been replaced with the illumination system 45 of this invention.

There is shown in FIG. 19 the battery 28, a transparent support 44, an information area 46, a transparent shield 47, and an illumination means 48. An alternate source of illumination 49 is shown in FIG. 21, which is an enlarged housing 16 and illuminating system 50. It is contemplated within the scope of this invention to use alternate means of illuminating the boot or boot information area such as back lighting as shown in FIG. 21, edge, side, or perimeter lighting as shown in FIG. 19, and the modes and methods of lighting as described supra.

FIG. 21 is a cross sectional view of just the system taken through the line XXI—XXI of FIG. 20.

Figure 22:
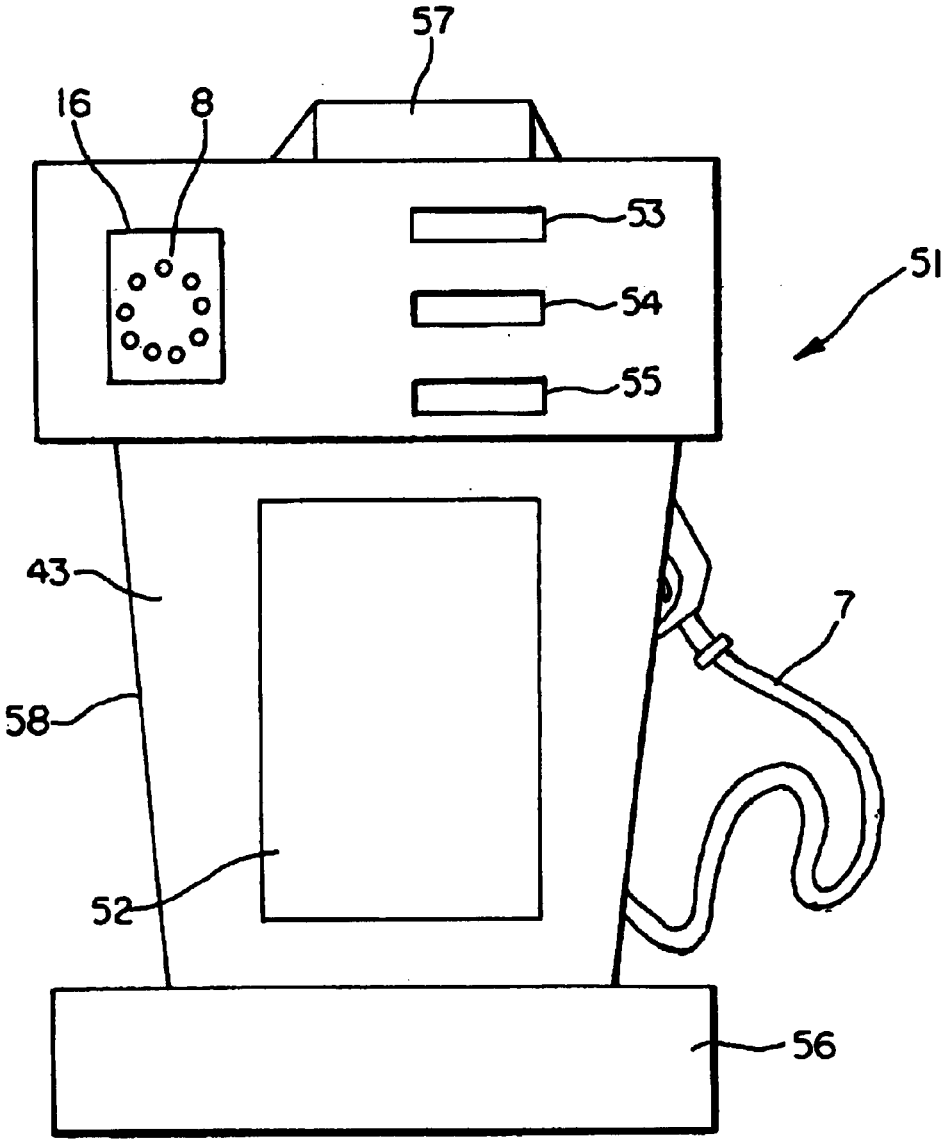
FIG. 22 is a full front view of a standard fuel pumping station showing the use of a system of this invention.

Turning now to the last aspect of this invention, the provision of a passive or interactive activity during the fueling of a vehicle, there is shown in FIG. 22, one placement of a system of this invention in order to provide the activity.

In FIG. 22, there is shown a standard fuel pump 51 consisting in part of a fuel delivery hose 7, a housing 43 for the pump (the pump not shown), a brand name display plaque 52, fuel sale register 53, fuel usage register 54, price of fuel register 55, a raised platform 56 to provide an anchor point for the fuel pump 51, and an advertising placard 57, along with a housing 16 which contains a system 8 of this invention. The Craig patent supra, is hereby incorporated by reference for what it teaches about standard fuel pumps.

It is contemplated within the scope of this invention that the system can be mounted on other than the fuel pump, for example, on an adjacent light pole, waste container, a wall, or the like, as long as the display screen is visible to the fueling customer and/or the customer can hear any sounds from the system 8.

Just as in the systems located in the nozzle of the fuel pump, the dislocated systems 8 of this aspect of the invention can be activated in many ways, for example, the systems can be designed such that the systems are activated when the fuel dispensing device is removed from the fuel nozzle rest or the fuel nozzle is inverted to pump fuel into the vehicle and can be deactivated when the fuel dispensing device is brought to a vertical, or near vertical position. The device can be thus deactivated by mere vertical orientation of the fuel dispensing device.

In the alternative, the systems can be activated and deactivated by a push button switch or other switch mechanism located near the systems and which can be operated by the consumer, station operator or remote attendant or device. In addition, the switch does not have to be located in the housing with the rest of the system, it can be dislocated from the pump. In a further alternative, the switch can be activated or deactivated by electronic pre-programming.

In addition, apparatus can be included in the systems to provide for the activation or deactivation of the system from remote locations, other than at the fuel dispensing device and therefore, it is contemplated within the scope of this invention that the systems can be either electrically hard wired, or can be wireless, and the device can receive or transmit commands and/or information by such means.

This electrical linking through hard wiring and wireless configurations also means that the devices, i.e. systems of this invention can be programmed, operated, or controlled from a location remote from the fuel dispensing device.

The boot or attachment system can have the form of a single or multiple piece configuration and be manufactured from such materials as thermoplastic or thermoset plastics. Such suitable systems are described in Fell and Alvern. The boot or attachment system can be secured by way of friction fit or held together by a clamping means, screws, adhesives or other such fastening means. The nozzle of the present invention includes an audio system which preferably includes a suitable speaker such as a mylar cone, 5 watt, 7,000 Hz system, which systems are commercially available.

The enclosures or cavities or systems of the present invention can include a power source in order to provide power to a delivery means for the pre-printed coupons; a system comprising a coupon printer delivery means for the printed coupons; a game, quiz, or survey system; an illumination system and combinations thereof. An example of a power source can be a battery type power source such as a 4.8 volt alkaline, lithium ion, or nickel cadmium battery system and/or a suitable solar energy power source, or the like, used independently or in combination with other internal or external electrical power sources.

Wireless systems can be, for example, those found in U.S. Department of Commerce publication "NTIA Special Publication 95-33 SURVEY OF RURAL INFORMATION INFRASTRUCTURE TECHNOLOGIES, September 1995, Wireless Systems and Technology."

What is claimed is:

1. A fuel dispensing nozzle for a fuel pump, comprising:

a housing having a front side and a rear side;

a spout attached to the housing at its front side;

a handle attached to the housing at its rear side; and an electronic system located within the housing between the spout and handle;

wherein the electronic system comprises a survey system.

2. A fuel dispensing nozzle for a fuel pump, comprising:

a housing having a front side, a rear side, and a top side, wherein the top side includes a recessed region;

a spout attached to the housing at its front side;

a handle integral with said housing; and an electronic system located outside the housing in the recessed region of the top side of the housing;

wherein the electronic system comprises a survey system.

* * * * *